US006024140A

United States Patent [19]

Garrison et al.

[11] Patent Number: 6,024,140

[45] Date of Patent: Feb. 15, 2000

[54] DISPENSING NOZZLES FOR PETROLEUM PRODUCTS

[75] Inventors: Timothy M. Garrison, Cincinnati; Charles A. Sunderhaus, Hamilton, both of Ohio

[73] Assignee: Dover Corporation, New York, N.Y.

[21] Appl. No.: 08/938,112

[22] Filed: Sep. 26, 1997

[51] Int. Cl.[7] ..... B65B 1/04

[52] U.S. Cl. ..... 141/59; 141/206

[58] Field of Search ..... 141/206–229, 141/59

[56] References Cited

U.S. PATENT DOCUMENTS

| | | |
|---|---|---|
| 3,996,979 | 12/1976 | Barr et al. . |
| 4,351,375 | 9/1982 | Polson . |
| 4,453,578 | 6/1984 | Wilder . |
| 4,697,624 | 10/1987 | Bower et al. . |
| 5,234,036 | 8/1993 | Butkovich et al. . |
| 5,297,594 | 3/1994 | Rabinovich . |
| 5,327,945 | 7/1994 | Simpson et al. . |
| 5,327,949 | 7/1994 | Dotson et al. . |
| 5,363,889 | 11/1994 | Simpson et al. . |
| 5,379,811 | 1/1995 | Dotson et al. . |
| 5,390,712 | 2/1995 | Parrish et al. . |
| 5,392,824 | 2/1995 | Rabinovich . |
| 5,394,909 | 3/1995 | Mitchell et al. . |
| 5,417,259 | 5/1995 | Schneider . |
| 5,435,356 | 7/1995 | Rabinovich . |
| 5,522,440 | 6/1996 | Mitchell . |
| 5,676,181 | 10/1997 | Healy ..... 141/206 |
| 5,765,609 | 6/1998 | Dalhart et al. . |

*Primary Examiner*—Steven O. Douglas
*Attorney, Agent, or Firm*—Dinsmore & Shohl LLP

[57] ABSTRACT

Dispensing nozzles having a spout for dispensing a fluid are provided. The spout comprises a first tube for engaging the dispensing nozzle and having an outer surface, a proximal end, a distal end, and a first passage interconnecting the proximal and distal ends. A second tube is disposed within the first passage of the first tube and communicates with a first opening on the outer surface of the first tube, the first opening being located adjacent the distal end. A valve seat is disposed at least partially within the first passage at the proximal end of the first tube and has a second passage disposed therein. A plug is disposed within the first passage between the valve seat and the distal end and has a third passage extending therethrough. A valve is disposed between the plug and the valve seat for sealingly engaging the valve seat, the valve being biased into engagement with the valve seat. The second tube engages the plug and communicates with a fourth passage disposed within the plug, the first tube having a second opening disposed on the outer surface adjacent the proximal end of the first tube which communicates with the fourth passage. In addition, the second and third passages are in fluid communication with the distal end during use.

18 Claims, 7 Drawing Sheets

DISPENSING NOZZLES FOR PETROLEUM PRODUCTS

TECHNICAL FIELD OF THE INVENTION

This invention relates generally to the field of dispensing nozzles for dispensing petroleum products, and, more particularly, to the field of gasoline dispensing nozzles incorporating an assembly for automatically terminating the flow of gasoline to a vehicle fuel tank when the tank is full.

BACKGROUND OF THE INVENTION

Nozzles for dispensing gasoline into a vehicle fuel tank at a gasoline service station are known in the art. Generally, there are two types of these dispensing nozzles, those that provide a vapor recovery capability and those that do not. Vapor recovery dispensing systems incorporate a vapor return path from the dispensing nozzle that is discharging the fuel into the vehicle fuel tank to the storage tank from which the fuel is being drawn for delivery to the vehicle. Fuel vapors, more particularly hydrocarbon vapors, can be thus returned to the storage tank (or other area of disposal) rather than being released into the atmosphere. A dispensing nozzle having a vapor recovery capability has both fuel and vapor passages within its nozzle body and is connected to an above ground dispensing pedestal by a hose that also includes both fuel and vapor passages.

Both vapor recovery and non-vapor recovery dispensing nozzles can incorporate an assembly for automatically terminating the flow of gasoline to a vehicle tank when the tank is fill or after a pre-paid amount of gasoline has been dispensed. The automatic shut-off assembly is adapted to release the lever controlling the flow of gasoline into the vehicle fuel tank when one of the aforementioned conditions occurs.

FIGS. 1 and 2 respectively illustrate a conventional vapor recovery dispensing nozzle 10 and a conventional non-vapor recovery dispensing nozzle 12, each of which incorporate a shutoff assembly 13 for automatically terminating the flow of gasoline to the vehicle fuel tank. Both conventional dispensing nozzles 10 and 12 comprise a spout 14 which engages an adapter 16, the adapter 16 sealingly engaging an outlet 18 of a nozzle body 19. The spout 14 of the non-vapor recovery nozzle 12 often threadably engages the adapter 16, as shown in FIG. 2. While these dispensing nozzles may have functioned well for the purposes for which they were intended, the threaded connection between the spout 14 and the adapter 16 of the non-vapor recovery nozzle 12 can be a source of potential gasoline leakage which can contaminate the environment and present a hazardous condition for the public. In addition, the spouts and adapters of these dispensing nozzles require substantially all metal construction which increases their weight. As such, there is a continuing need to provide dispensing nozzles having improved features which eliminate sources of potential gasoline leaks and which have improved performance characteristics. Still further, there is a continuing need to provide dispensing nozzles which are simpler in construction, easier to manufacture, and lighter in weight for user convenience. The present invention incorporates improved features and structures which can provide the above-described benefits.

SUMMARY OF THE INVENTION

It is an object of the present invention to provide improved dispensing nozzles of simplified design which can accommodate an assembly for automatically terminating the flow of gasoline to a vehicle tank.

It is another object of the present invention to provide improved dispensing nozzles having improved performance characteristics.

It is a further object of the present invention to provide improved dispensing nozzles which are simpler and more efficient to manufacture.

It is a still further object of the present invention to provide improved dispensing nozzles which eliminate sources of potentially hazardous gasoline leaks.

It is still another object of the present invention to provide improved dispensing nozzles which are lighter in weight for ease of use In accordance with one aspect of the present invention, an improved spout for use with a dispensing nozzle and a dispensing nozzle incorporating an improved spout are provided. The spout comprises a first tube for engaging the dispensing nozzle and having an outer surface, a proximal end, a distal end, and a first passage interconnecting the proximal and distal ends. A second tube is disposed within the first passage of the first tube and communicates with a first opening on the outer surface of the first tube, the first opening being located adjacent the distal end. A valve seat is disposed at least partially within the first passage at the proximal end of the first tube and has a second passage disposed therein. A plug is disposed within the first passage between the valve seat and the distal end and has a third passage extending therethrough. A valve is disposed between the plug and the valve seat for sealingly engaging the valve seat, the valve being biased into engagement with the valve seat.

The second tube engages the plug and communicates with a fourth passage disposed within the plug, the first tube having a second opening disposed on the outer surface adjacent the proximal end of the first tube which communicates with the fourth passage. In addition, the second and third passages are in fluid communication with the distal end during use.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

DETAILED DESCRIPTION OF THE PREFERRED EMBODIMENTS

Figure 1:
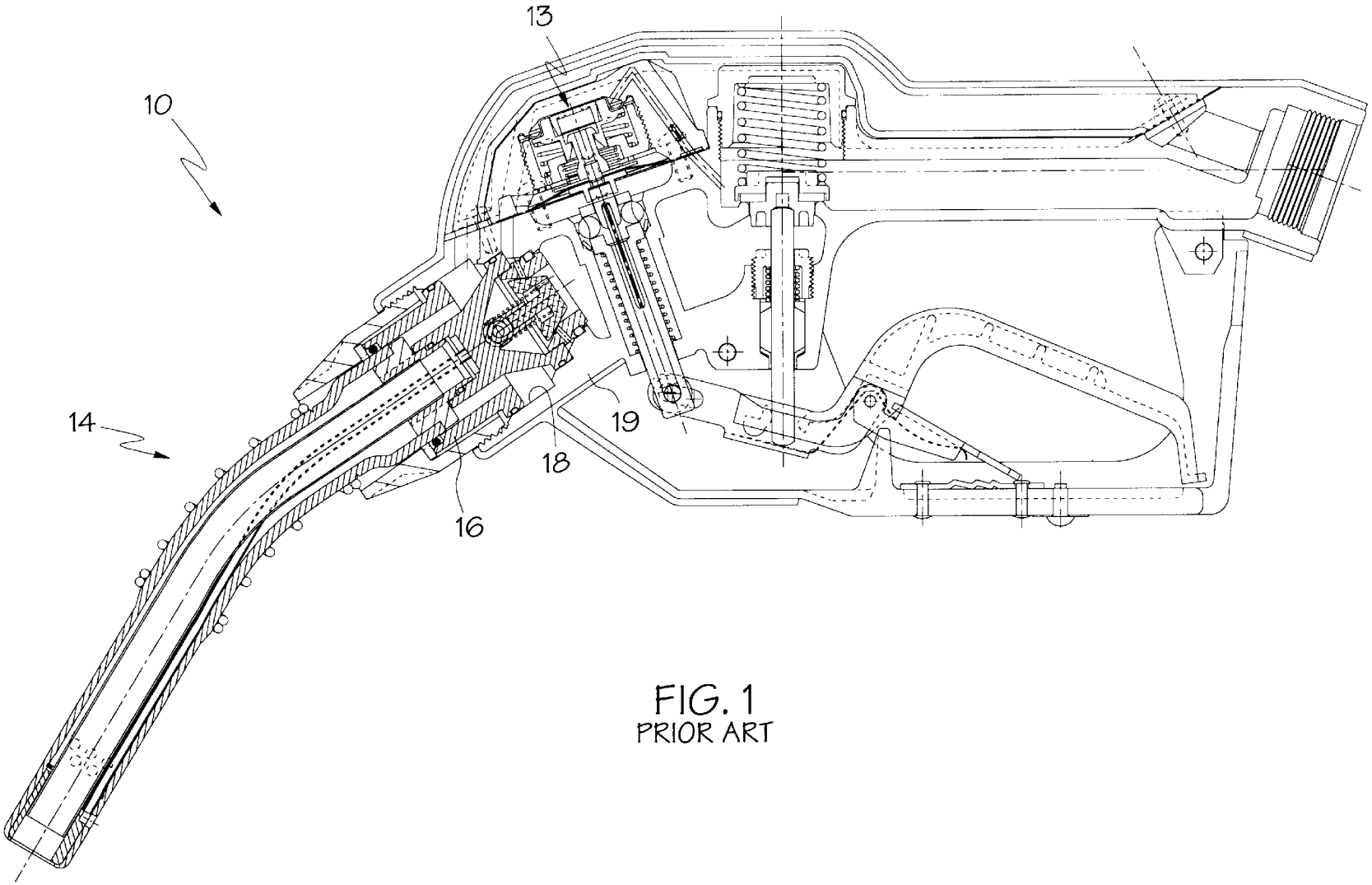
FIG. 1 PRIOR ART
FIG. 1 is a cross-sectional side view of a conventional vapor recovery dispensing nozzle.
Figure 2:
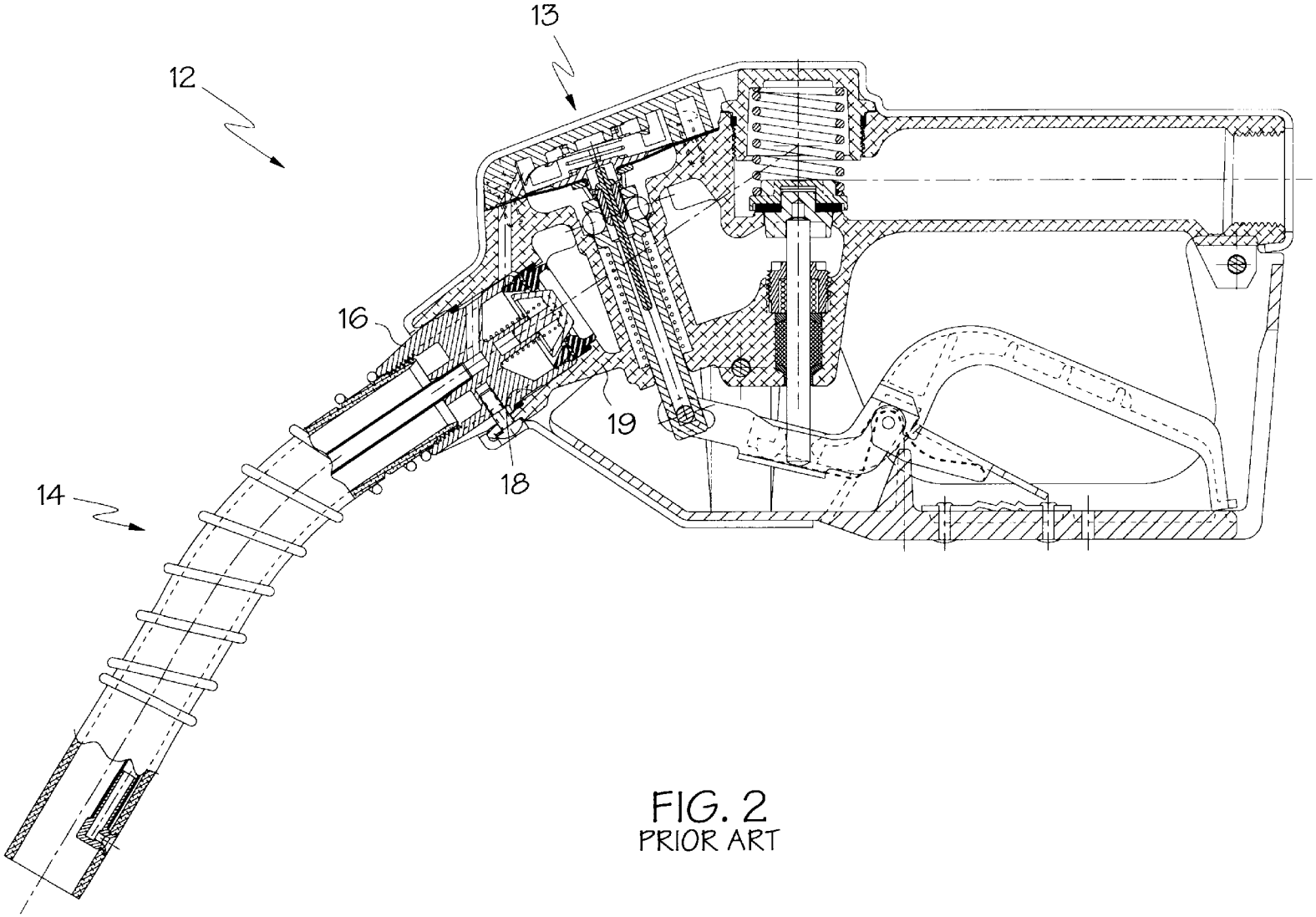
FIG. 2 PRIOR ART
FIG. 2 is a cross-sectional side view of a conventional dispensing nozzle suitable for use in a non-vapor recovery dispensing system.
Figure 3:
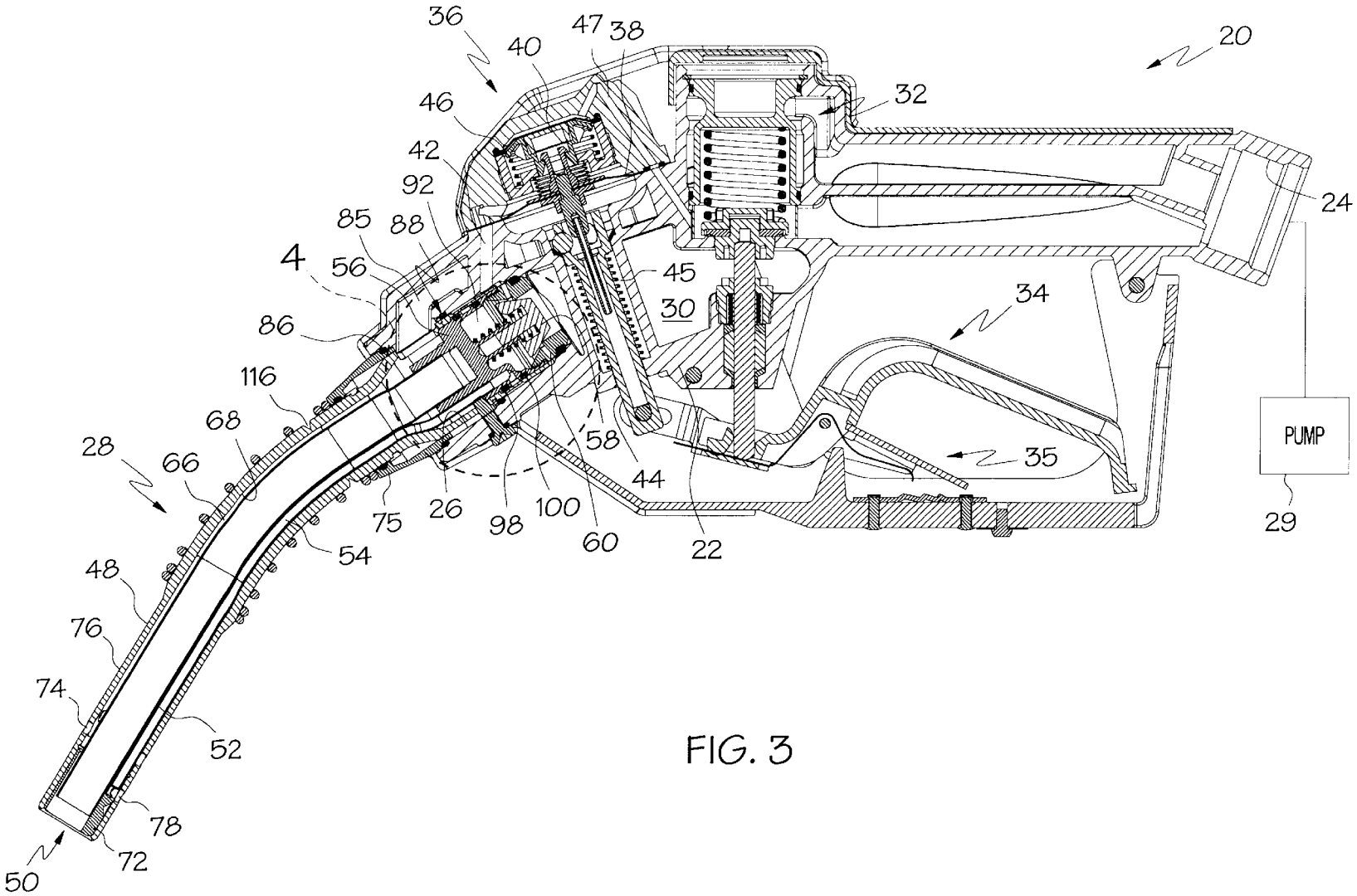
FIG. 3 is a cross-sectional side view of a preferred vapor recovery dispensing nozzle made in accordance with the present invention.

Reference will now be made in detail to the present preferred embodiments of the invention, examples of which are illustrated in the accompanying drawings, wherein like numerals indicate the same elements throughout the views and wherein numerals having the same last two digits (e.g., 20, 120) connote corresponding parts or assemblies between various embodiments. A particularly preferred embodiment of the present invention is illustrated in FIG. 3 in the form of a vapor recovery dispensing nozzle 20. As will be understood more fully hereafter, the present invention relates to dispensing nozzles having an improved spout for engaging a nozzle body of a dispensing nozzle having an automatic shutoff assembly. As shown in FIG. 3, the vapor recovery dispensing nozzle 20 comprises a nozzle body 22 having an inlet 24, an outlet 26, and a spout 28 which engages the outlet 26. The inlet 24 of the nozzle body 22 is typically connected to a hose which is in liquid communication with a pump 29 (shown schematically in FIG. 3). The pump 29 is adapted to deliver a liquid, such as gasoline, at a predetermined pressure to the vapor recovery dispensing nozzle 20 for transfer to a container, such as a fuel tank of a vehicle. While the present invention is most suited for use with dispensing nozzles for petroleum products, such as gasoline, it is contemplated that the present invention can be adapted to dispense other liquid products as desired.

A body passage 30 interconnects the inlet 24 and outlet 26 so that liquid delivered by the pump 29 to the inlet 24 can flow to the outlet 26 and into the spout 28 which engages the outlet 26. A main poppet valve 32 is disposed within the body passage 30 for regulating the flow of liquid therein. The main poppet valve 32 is connected to a lever 34 for opening and closing the main poppet valve 32. The lever can be maintained in a position for holding the main poppet valve open by a latching mechanism 35, this mechanism being described more fully in U.S. Pat. No. 3,653,415 to Boudot et al. which is fully incorporated herein by reference. In addition, the details of the construction and operation of the lever 34 and the main poppet valve 32 are known in the art and are more fully described in U.S. Pat. Nos. 4,351,375 to Polson and 3,811,486 to Wood, which are also hereby fully incorporated herein by reference.

Also connected to the lever 34 is an automatic shutoff assembly, designated generally as 36. The automatic shutoff assembly 36 comprises a first diaphragm 38 which is responsive to the liquid in the tank reaching a predetermined level such that the liquid flow through the vapor recovery dispensing nozzle 20 is automatically stopped by closure of the main poppet valve 32. Liquid flow through the dispensing nozzle 20 is also stopped by the automatic shutoff assembly 36 when a second diaphragm 40 responds to inactivation of the pump 29 supplying the liquid to the vapor recovery dispensing nozzle 20. The details of the construction and operation of the automatic shutoff assembly 36 are known in the art and are discussed more fully in U.S. Pat. No. 4,453,578 to Wilder, which is hereby fully incorporated herein by reference. However, for clarity of later discussion, certain additional details of the operation of the automatic shutoff assembly 36 will now be discussed.

The automatic shutoff assembly 36 communicates with a vacuum passage 42 disposed within the nozzle body 22. During operation, a vacuum is generated in the vacuum passage 42 by a venturi effect created within the spout 28, as discussed more fully hereafter, when the liquid level in the vehicle fuel tank reaches a predetermined position adjacent the end of the spout 28. The vacuum which is generated within the vacuum passageway 42 raises the first diaphragm 38 upwardly (as shown in FIG. 3), thereby allowing the latch plunger 44 to translate downwardly against the force of spring 45 by the force of the spring of the main poppet valve 32. This results in the main poppet valve 32 being moved to its closed position, as discussed more fully in the Wilder patent, to terminate the flow of gasoline to the vehicle fuel tank. Alternatively, the main poppet valve 32 can be automatically moved to its closed position when the pump 29 is inactivated after dispensing a predetermined amount of gasoline. More particularly, the second diaphragm 40 is raised upwardly by the spring 46 (as shown in FIG. 3) when the liquid pressure in a diaphragm passage 47 communicating with the body passage 30 decreases following inactivation of the pump 29. The upward movement of the second diaphragm 40 allows the latch plunger 44 to translate downwardly against the force of spring 45, as previously described, such that the main poppet valve 32 is moved to its closed position.

Figure 4:
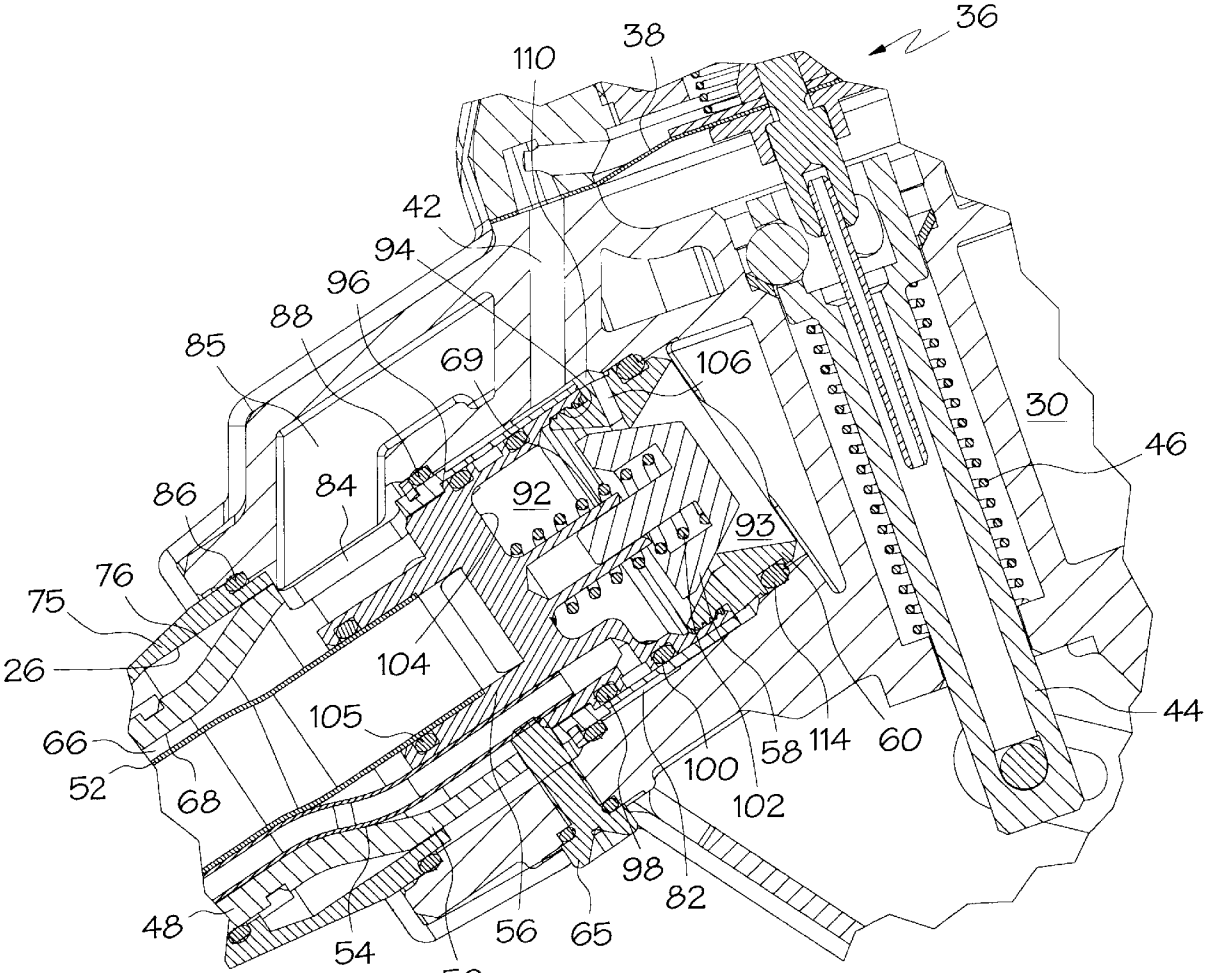
FIG. 4 is an enlarged partial cross-sectional side view of the vapor recovery dispensing nozzle of FIG. 3, as indicated at circle 4 thereof.
Figure 5:
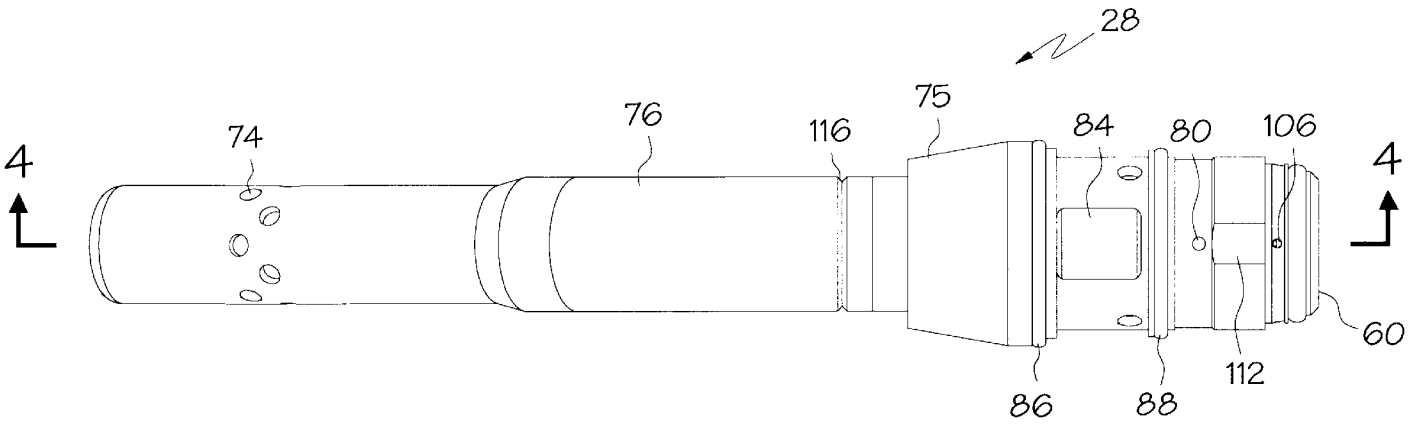
FIG. 5 is a top view of a spout suitable for use in the vapor recovery dispensing nozzle of FIG. 3.
Figure 6:
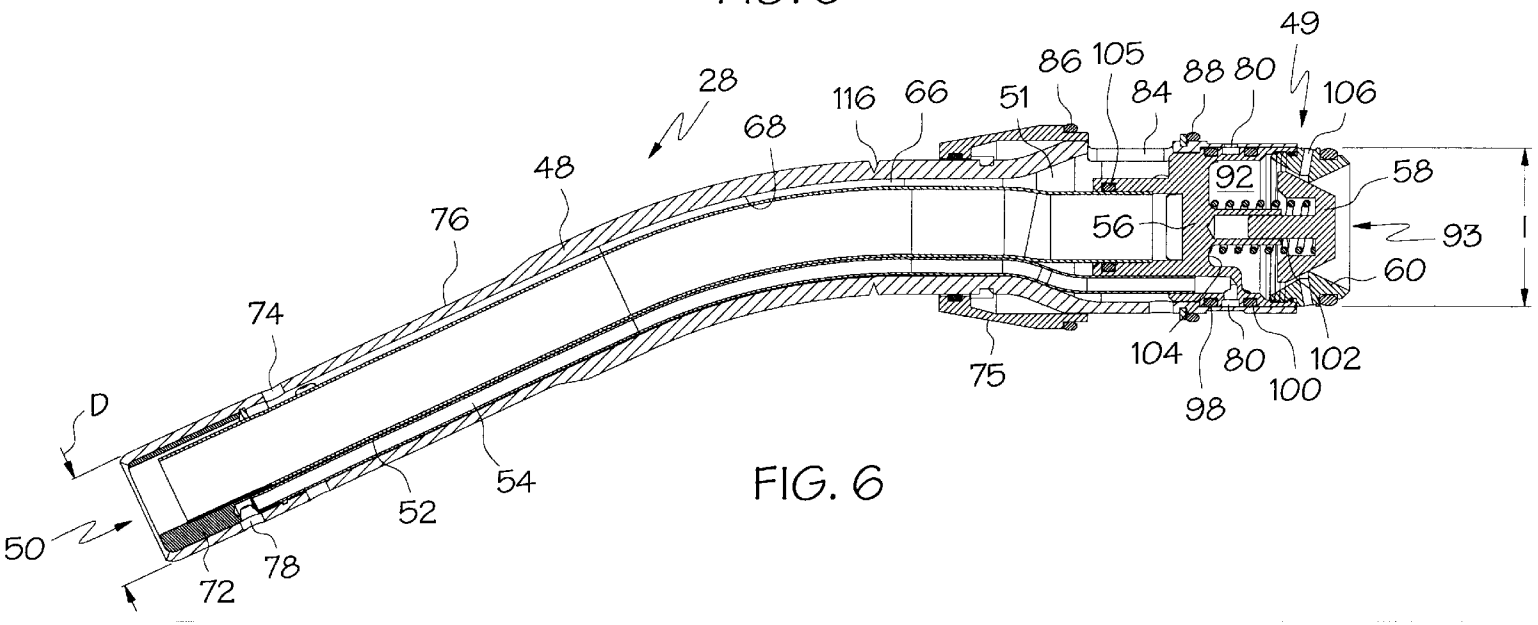
FIG. 6 is a cross-sectional side view of the spout of FIG. 5.

Referring to FIGS. 4, 5, and 6 and in accordance with one aspect of the present invention, the spout 28 will now be described in greater detail. The spout 28 comprises an outer tube 48 having a proximal end 49, a distal end 50, and a tube passage 51 (FIG. 6) extending therebetween. The spout 28 also comprises first and second inner tubes 52 and 54 disposed within the tube passage 51, a valve 58 for engaging a valve seat 60 and for regulating the flow of liquid between body passage 30 and the spout 28, and a plug 56 disposed within the tube passage 51 between the distal end 50 and the valve seat 60. The proximal end 49 of the outer tube 48 engages the outlet 26 of the nozzle body 22 and the distal end 50 is adapted for insertion into the vehicle fuel tank receiving the liquid. The spout 28 is retained in engagement with the outlet 26 of the nozzle body 22 by a screw 65 extending radially inwardly toward the outer tube 48 and passing through an opening in the nozzle body 22. The screw 65 threadably engages the outer tube 48 so that the spout 28 is prevented from axially moving or rotating relative to the nozzle body 22 when assembled. While the dispensing nozzle 20 is illustrated as comprising a single screw 65 for interconnecting the nozzle body 22 and the spout 28, it is contemplated that a plurality of screws 65 can be provided. Other methods of attachment can also be provided. For instance, an internally threaded nut or lock ring which engages the female threads on the nozzle body can be used to interconnect the spout 28 and the nozzle body 22.

Preferably, the inside diameter I of the proximal end 49 of the outer tube 48 is greater than the outside diameter D of the distal end 50 of the outer tube 48 so that the proximal end 49 can accommodate the plug 56 and the valve seat 60 while the distal end 50 of the outer tube 48 can still be inserted into the more narrow opening of an unleaded vehicle fuel tank. The outer tube 48 is preferably formed from aluminum tubing with the inside diametrical surface of the proximal end 49 being expanded by impact extrusion or other methods known in the art and the outside diametrical surface of the smaller distal end 50 of the outer tube 48 being formed by a swaging process, machining or the like.

A vapor recovery annulus 66 is preferably formed between the inner surface 68 of the outer tube 48 and the first inner tube 52 for the recovery of vapors from the vehicle fuel tank into which the liquid is being dispensed. More particularly, the first inner tube 52 engages a ferrule 72 disposed within the distal end 50 of the outer tube 48. A plurality of vapor holes 74 are disposed in an outer surface 76 of the outer tube 48 adjacent its distal end 50 and communicate with the vapor recovery annulus 66. As liquid is dispensed into the vehicle fuel tank, vapors can be drawn from the vehicle fuel tank into the vapor recovery annulus 66 through the vapor holes 74. A vacuum hole 78 is also disposed in the outer surface of the outer tube 48 adjacent its distal end 50. The vacuum hole 78 communicates with the second inner tube 54. A sleeve 75, preferably formed from a plastic resin, can be provided adjacent the outer surface 76 of the outer tube 48 for centering the spout 28 within the outlet 26 of the nozzle body 22. The sleeve 75 also supports the spout 28, thereby tending to minimize movement of the spout 28 from forces applied to the spout during use.

The second inner tube 54 is disposed within the vapor recovery annulus 66 and engages the plug 56 disposed adjacent the proximal end 49 of outer tube 48. The second inner tube 54 communicates with a first aperture 80 disposed in the outer surface 76 of the outer tube 48 adjacent the proximal end 49, as most clearly seen in FIGS. 5 and 6.

When the spout 28 engages the nozzle body 22, as shown in FIG. 4, the outer surface 76 of the outer tube 48 in cooperation with the outlet 26 forms a first annulus 82 which is in communication with the first aperture 80. A substantially square shaped opening 84 disposed in the outer surface 76 of the outer tube 48 communicates with the vapor recovery annulus 66 of the spout 28 so that vapors within the vapor recovery annulus 66 can be delivered to a vapor return passage 85 extending through the nozzle body 22 to the inlet 24. A pair of seals 86 and 88 are provided on either side of the substantially square shaped opening 84 for sealing the vapor return passage 85 from the ambient environment (seal 86) and from the first annulus 82 (seal 88). The seal 86 preferably engages the sleeve 75 and the nozzle body 22 while the seal 88 engages the outer tube 48 and the nozzle body 22.

As shown most clearly in FIGS. 4 and 6, the plug 56 is disposed within the tube passage 51 adjacent the proximal end 49 of the outer tube 48. The plug 56 has a plug passage 92 extending therethrough interconnecting the first inner tube 52 with the a valve seat passage 93 so that liquid fuel delivered to the inlet 24 by the pump 29 can be dispensed from the distal end 50 of the spout 28 through the first inner tube 52. The plug 56 sealingly engages the first inner tube 52 in cooperation with a seal 105 at one end and has an internal female thread 94 at the opposite end for threadably receiving the valve seat 60. While it is preferred that the valve seat 60 threadably engages the plug 56, it is contemplated that other arrangements would be suitable. For instance, a tang and slot arrangement could be used. The plug 56 engages or bottoms on an annular rim 96 of the outer tube 48, thereby axially locating the plug 56 within tube passage 51 of the outer tube 48. The plug 56 is preferably retained within the tube passage 51 by the frictional engagement of seals 98 and 100 with the same, these seals being disposed on either side of the first aperture 80. Seals 98 and 100 also seal the first aperture 80 and the annulus 82 from any liquid fuel which might leak past the annular rim 96 during use.

A cylindrically-shaped hollow post 69 is disposed substantially within the plug passage 92 and extends away from a base 104 of the plug 56. The post 69 slidably receives the valve 58 which is biased into engagement with the valve seat 60 by a spring 102. The bias of the spring 102 is preferably overcome by the liquid pressure exerted on the valve 58 whenever the pump 29 is activated and the main poppet valve 32 is in its open position. A plurality of venturi passages 106 are disposed within the valve seat 60 for communicating with the valve seat passage 93 such that a venturi effect is generated by the flow of liquid fuel through the valve seat passage 93 when the valve 58 is in its open position. The plurality of venturi passages 106 communicate with a second annulus 110 formed between the outer surface 76 of the outer tube 48 and the nozzle body 22. A groove 112 (FIG. 5) interconnecting the first annulus 82 and the second annulus 110 communicates with the vacuum passage 42 so that the vacuum created in the plurality of venturi passages 106 by the venturi effect when the liquid fuel in the vehicle fuel tank reaches the vacuum hole 78 of the spout 28 can be transmitted to the automatic shut off assembly 36. The vacuum transmitted to the shutoff assembly 36 raises the first diaphragm 38 upwardly, as shown in FIG. 3, thereby releasing the latch plunger 44 so that the main poppet valve 32 will move to its closed position as previously discussed. As will be apparent, the body passage 30, the valve seat passage 93, the plug passage 92, and the first inner tube 52 are in fluid communication with each other when the main poppet valve 32 and the valve 58 are in their open positions. A forward seal 114 is disposed adjacent the entrance to the valve seat passage 93 of the valve seat 60 for separating liquid fuel in the body passage 30 from second annulus 110.

The outer tube 48 can be provided with a stress inducing notch 116 (e.g., FIG. 3) so that the outer tube 48 will preferentially fracture at this location if the dispensing nozzle 20 is left in the fill spout of a vehicle fuel tank when the vehicle is moved. The notch 116 preferably encircles the outer spout 48 so that movement of the vehicle away from the gasoline pump will force the dispensing nozzle 20 to pivot and the outer tube 48 to fracture at the notch 116. As will be understood, placement of the plug 56 within the tube passage 51 of the outer tube 48 removes the plug 56 from the load path during such a fracture event so that the plug 56 of the present invention can be formed from lighter weight and lower strength materials, such as a plastic resin, rather than relatively heavier metals (e.g., zinc or aluminum) having the higher strengths which are needed in conventional dispensing nozzles where the plug forms part of the load path. Because the plug 56 of the present invention can be formed from a resin, a simplified connection between the first inner tube 52 and the plug 56 can be further provided, wherein the first inner tube 52 is solvent cemented to create both a connection and seal with the plug 56 such that the seal 105 can be eliminated. In addition, placement of the plug 56 within the outer tube 48 and retention of the spout 28 by the screw 65 provides a simplified design which is easier to manufacture and, among other things, eliminates turbulence generating structures (e.g., steps) which can create pressure losses in conventional dispensing nozzles.

The preferred dispensing nozzle 20 and spout 28 can be assembled by engaging the first and second inner tubes 52 and 54 with the plug 56 and installing the spring 102 and the valve 58 such that the valve seat 60 can be threaded into the plug 56. This combination is inserted into the tube passage 51 through the proximal end 49 of the outer tube 48 until the plug 56 bottoms on the annular race 96. The assembled spout 28 can then be inserted into the outlet 26 of the nozzle body 22 and retained in place by the screw 65.

Figure 7:
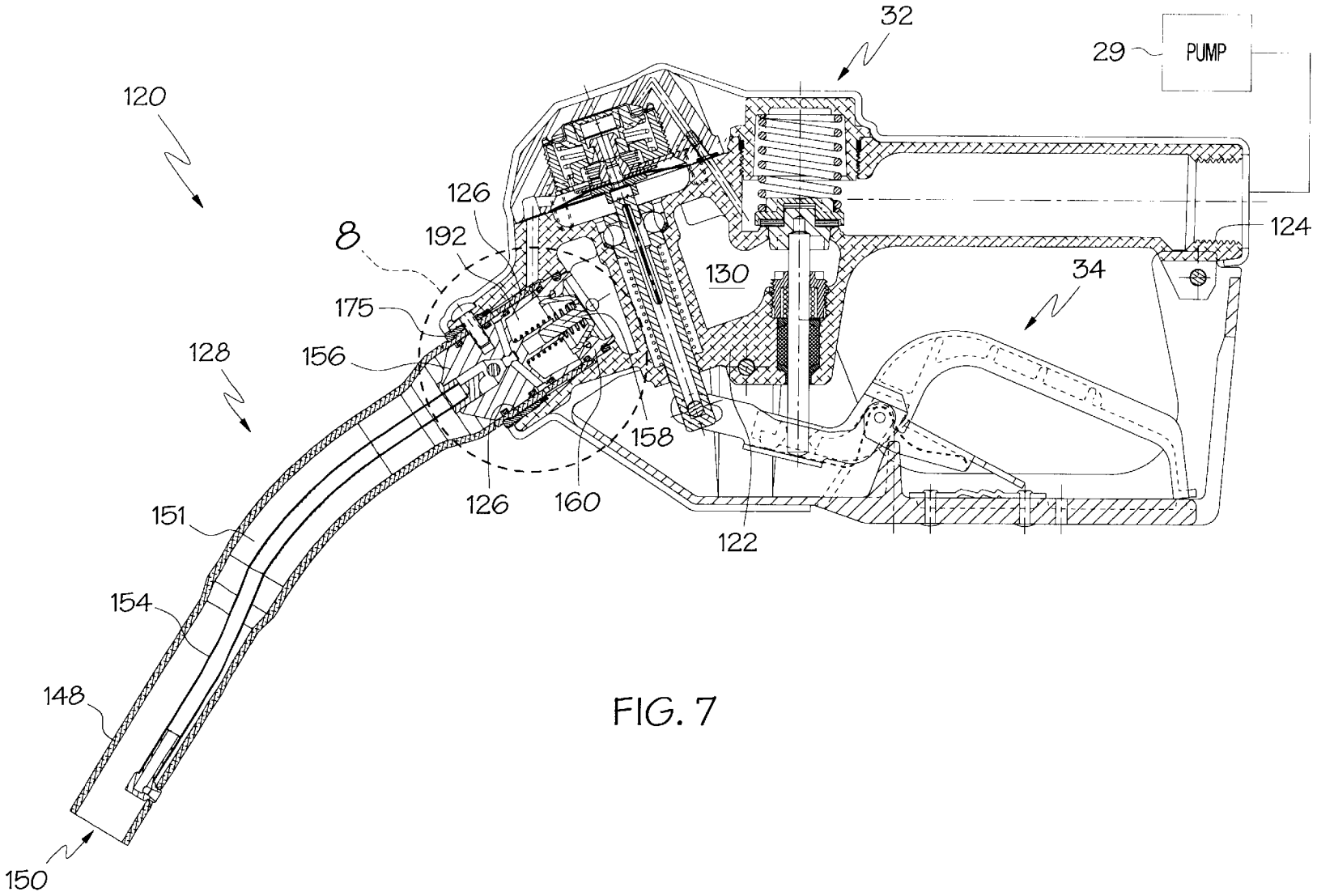
FIG. 7 is a cross-sectional side view of another preferred dispensing nozzle made in accordance with the present invention suitable for use in a non-vapor recovery dispensing system.
Figure 8:
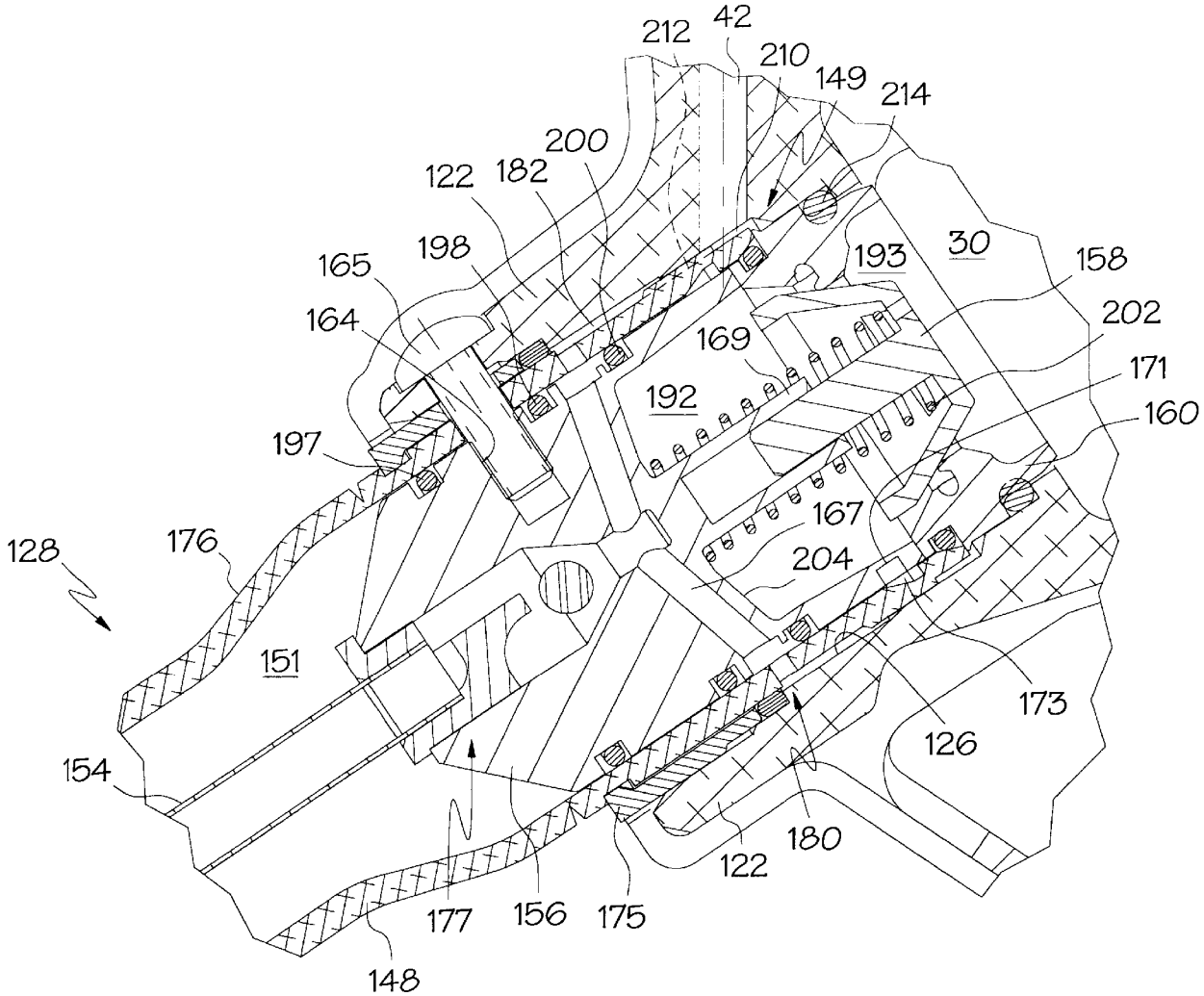
FIG. 8 is an enlarged cross-sectional side view of the dispensing nozzle of FIG. 7 as indicated at circle 8 thereof.

Referring to FIGS. 7 and 8, another preferred embodiment of the present invention in the form of a dispensing nozzle 120, which does not have a vapor recovery capability, will now be described. As will be understood, the benefits previously described with respect to the dispensing nozzle 20 (e.g., lighter weight, simpler construction, lower pressure losses, etc) can also be accommodated by the preferred dispensing nozzle 120. In addition, the preferred dispensing nozzle 120 and spout 128 also eliminate the threaded connection between the spout and adapter of a conventional non-vapor recovery dispensing nozzle which can be a source of gasoline leaks which contaminate the environment and present a hazardous condition for the public. The dispensing nozzle 120 comprises a nozzle body 122 having an inlet 124, an outlet 126 and a spout 128 which engages the outlet 126. A body passage 130 interconnects the inlet 124 and the outlet 126, wherein a main poppet valve 32 disposed substantially within the body passage 130 and which is controlled by a lever 34 regulates the flow of liquid through the body passage 130. Likewise, an automatic shutoff assembly 36 having a first diaphragm 38 and a second diaphragm 40 is provided as previously described.

The spout 128 comprises an outer tube 148 having a proximal end 149 (FIG. 8), a distal end 150 (FIG. 7), and a tube passage 151 extending therebetween. The spout 128 also comprises an inner tube 154 disposed within the tube passage 151, a valve 158 for engaging a valve seat 160, and a plug 156 disposed within the tube passage 151 between the distal end 150 and the valve seat 160. The proximal end 149 of the outer tube 148 engages the outlet 126 of the nozzle body 122 and the distal end 150 is adapted for insertion into the vehicle fuel tank receiving the liquid. The plug 156 has a threaded hole 164 for threadably engaging a screw 165 which passes through the nozzle body 122 and the outer tube 148, as shown most clearly in FIG. 8. Thus, the screw 165 orients the spout 128 with respect to the nozzle body 122 and retains the spout 128 in engagement with the outlet 126. In addition, the screw 165 positions the plug 156 within the tube passage 151 and retains the plug 156 within the same when assembled. The plug 156 has a plurality of generally radially extending passages 167 disposed therein which communicate with both the inner tube 154 and a plurality of first apertures 180 disposed in the outer surface 176 of the outer tube 148. A pair of seals 197 and 198 are disposed on either side of the threaded hole 164 for sealing the threaded hole from the tube passage 151 and the passages 167, thereby preventing both leakage of liquid fuel to the environment and the drawing ambient air into a first annulus 182 formed between the outer surface 176 of the outer tube 148 and the outlet 126 of the nozzle body 122. A plurality of grooves 212 (shown in dashed) are disposed between the first annulus 182 and a second annulus 210 also formed between the outer surface 176 of the outer tube 148 and the outlet 126 of the nozzle body 122. The grooves 212 provide communication between the inner tube 154 and the vacuum passage 42 communicating with the automatic shut off assembly 36. In addition, the grooves 212 provide communication between the first annulus 182 and the second annulus 210.

The plug 156 has a plug passage 192 extending therethrough which is in fluid communication with a valve seat passage 193 extending through the valve seat 160. The plug 156 also comprises a substantially cylindrically-shaped hollow post 169 disposed substantially within the plug passage and which extends away from a base 204 of the plug 156. The post 169 slidably receives the valve 158 which is biased into engagement with the valve seat 160 by a spring 202. The valve seat 160 extends at least partially into the proximal end 149 of the outer tube 148 and has a plurality of deformable and substantially resilient tangs 171 for engaging a slot 173 extending about the inner surface of the tube passage 151 adjacent the proximal end 149. A forward seal 214 is disposed between the valve seat 160 and the proximal end 149 of the outer tube 148 for separating the second annulus 210 from the body passage 30. A sleeve 175 preferably formed from a plastic resin can be provided adjacent the outer surface 176 of the outer tube 148 for centering the spout 128 within the outlet 126 of the nozzle body 122 as well as providing support thereto during use.

Having shown and described the preferred embodiments of the present invention, further adaptions of the dispensing nozzles described herein can be accomplished by appropriate modification by one of ordinary skill in the art without departing from the scope of the present invention. Several of such potential modifications have been mentioned, and others will be apparent to those skilled in the art. For example, while a plug of the present invention have been described as being disposed within the tube passage, it is contemplated that a plug of the present invention need only be disposed partially within the tube passage where the valve seat engages the plug rather than the outer tube. In addition, a plug can incorporate additional structures such as an attitude assembly 177 which is known in the art and shown by way of example in FIG. 8. The particular embodiments shown and described herein are intended only as preferred exemplary arrangements of the various structures and functions of the present invention. Accordingly, the scope of the present invention should be considered in terms of the following claims and is understood not be limited to the details of structure and operation shown and described in the specification and drawings.

What is claimed is:

1. A nozzle for dispensing a fluid, comprising:

a nozzle body having an inlet, an outlet, and a first passage connecting said inlet and said outlet;

a first tube engaging said body and having an outer surface, a proximal end, a distal end and a second passage interconnecting said proximal and distal ends;

a second tube disposed within said second passage of said first tube and communicating with a first opening on said outer, surface of said first tube, said first opening being located adjacent said distal end;

a plug disposed at least partially within said second passage of said first tube and having third and fourth passages disposed therein, said second tube communicating with said third passage such that said first opening and said third passage are in communication with each other;

a valve seat in communication with both said first passage of said nozzle body and said fourth passage of said plug;

a valve disposed between said plug and said valve seat for sealingly engaging said valve seat, said valve being biased into engagement with said valve seat; and a shutoff assembly in communication with said third passage for terminating the flow of fluid through the nozzle when the fluid reaches said first opening.

2. The nozzle of claim 1, further comprising a third tube disposed within said second passage of said first tube, said third tube engaging said plug and communicating with said distal end of said first tube and said fourth passage of said plug, wherein the fluid is dispensed through said third tube.

3. The nozzle of claim 2, wherein said first tube and said third tube form an first annulus therebetween for collecting vapors, said second tube being disposed within said first annulus.

4. The nozzle of claim 3, further comprising a second opening adjacent said plug and communicating with said first annulus for directing the vapors into said nozzle body.

5. The nozzle of claim 1, wherein said valve seat threadably engages said plug.

6. The nozzle of claim 1, wherein said valve seat further comprises a tab and said first tube further comprises a slot, said tab engaging said slot to retain said valve seat at least partially within said second passage of said first tube.

7. The nozzle of claim 6, wherein said tab is at least partially deformable and resilient to facilitate insertion of said valve seat into said first tube.

8. The nozzle of claim 1, further comprising a screw engaging said nozzle body and said first tube.

9. The nozzle of claim 1, further comprising a screw engaging said nozzle body, said first tube and said plug.

10. The nozzle of claim 1, wherein said plug is formed from a plastic.

11. The nozzle of claim 1, wherein the inside diameter of said proximal end of said first tube is greater than the inside diameter of said distal end of said first tube.

12. The nozzle of claim 1, wherein said first tube further comprises a rim and said plug engages said rim.

13. The nozzle of claim 1, wherein said outer surface of said first tube and said outlet of said nozzle body form a second annulus therebetween which is in communication with both said third passage of said plug and said shutoff assembly.

14. The nozzle of claim 1, wherein said plug is disposed completely within said second passage of said first tube.

15. The nozzle of claim 1, wherein said valve seat is disposed at least partially within said second passage of said first tube.

16. The nozzle of claim 1 wherein said valve seat is disposed at least partially within said outlet of said nozzle body.

17. A nozzle for dispensing a fluid, comprising:

a nozzle body having an inlet, an outlet and a first passage connecting said inlet and said outlet;

a first tube engaging said body and having an outer surface, a proximal end, a distal end and a second passage interconnecting said proximal and distal ends;

a plug disposed completely within said second passage of said first tube and having a third passage extending therethrough;

a valve seat in communication with both said first passage of said nozzle body and said third passage of said plug; and a valve disposed between said plug and said valve seat for sealingly engaging said valve seat, said valve being biased into engagement with said valve seat.

18. A nozzle for dispensing a fluid, comprising:

a nozzle body having an inlet, an outlet and a first passage connecting said inlet and said outlet;

a first tube engaging said body and having an outer surface, a proximal end, a distal end and a second passage interconnecting said proximal and distal ends;

a plug disposed at least partially within said second passage of said first tube and having a third passage extending therethrough;

a valve seat disposed at least partially within said second passage, and in communication with both said first passage of said nozzle body and said third passage of said plug; and a valve disposed between said plug and said valve seat for sealingly engaging said valve seat, said valve being biased into engagement with said valve seat.

* * * * *